United States Patent [19]

Fukuhara et al.

[11] Patent Number: 4,490,828

[45] Date of Patent: Dec. 25, 1984

[54] ELECTRIC RESISTANCE HEATING ELEMENT AND ELECTRIC RESISTANCE HEATING FURNACE USING THE SAME AS HEAT SOURCE

[75] Inventors: Mototada Fukuhara; Keizo Ono, both of Ehime; Ken-ichi Morita, Fujisawa; Shigeru Fujii, Ehime, all of Japan

[73] Assignee: Toray Industries, Inc., Tokyo, Japan

[21] Appl. No.: 451,391

[22] Filed: Dec. 20, 1982

[30] Foreign Application Priority Data

Dec. 18, 1981 [JP] Japan ..... 56-203460
Feb. 12, 1982 [JP] Japan ..... 57-21291

[51] Int. Cl.[3] ..... H05B 3/40

[52] U.S. Cl. ..... 373/117; 219/553; 338/259; 373/132

[58] Field of Search ..... 373/117, 111, 132, 127; 219/553, 535; 338/259

[56] References Cited

U.S. PATENT DOCUMENTS 3,213,177 10/1965 Diefendorf ..... 373/132
3,403,212 9/1968 Sato ..... 373/132
3,607,063 9/1971 Douglas et al. .
4,164,646 8/1979 Grise ..... 219/553

FOREIGN PATENT DOCUMENTS 46-13540 4/1971 Japan .
47-33024 8/1972 Japan .

*Primary Examiner*—Roy Envall
*Attorney, Agent, or Firm*—Armstrong, Nikaido, Marmelstein & Kubovcik

[57] ABSTRACT

An improved electric resistance heating element made of a carbon material, provided around its surface with a layer essentially comprising carbon fiber, and an improved electric resistance heating furnace using the heating element.

16 Claims, 6 Drawing Figures

ELECTRIC RESISTANCE HEATING ELEMENT AND ELECTRIC RESISTANCE HEATING FURNACE USING THE SAME AS HEAT SOURCE

BACKGROUND

The present invention relates to an electric resistance heating element made of a carbon material and, more specifically, to an improved electric resistance heating element formed by providing around a tube a layer essentially comprising carbon fiber, as well as a heating furnace using this heating element.

As high-temperature heating furnaces employed for manufacture of various industrial materials such as carbon fiber, graphite fiber and other carbon materials and also ceramics or the like, there have been known a great variety of industrial furnaces such as electric resistance heating furnaces, induction heating furnaces, arc heating furnaces, plasma heating furnaces, etc.

Among these high-temperature heating furnaces, the Tamman heating furnace (hereinafter referred to as "Tamman furnace") wherein a cylindrical carbon material is employed and electrodes are provided at both ends thereof across which electric current is supplied for heating, is particularly widely employed as a heating furnace for the manufacture of the above-mentioned industrial materials, since the heating means thereof is relatively simple.

The above-mentioned Tamman furnace has, such a structure in which a cylindrical heating tube made of a carbon material is surrounded by a thermal insulating material, and the inside of the heating tube thereof is a heat treatment chamber, in which an object to be thermally treated is disposed or passed, and a current is supplied between the electrodes provided at both ends of the heating tube in order to generate Joule heat for heating the object the heat treatment chamber. Generally, the temperature of the furnace is extremely high and the inside of the heat treatment chamber is maintained under an atmosphere of an inert gas, such as nitrogen, argon, helium or the like, or a pressure having been reduced or a vacuum.

Carbon or graphite materials are employed as the heating tube of the Tamman furnace, because of its thermal stability, i.e., these materials never fuse or pyrolytically decompose even in a high-temperature region of 2000° to 3000° C., and function satisfactorily as an electric heating element.

However, the heating tube itself is gradually exhausted in case of heating over a long period of time under a temperature of 2000° to 3000° C. or higher than the same in a Tamman furnace having the above-mentioned structure. Moreover, as the heating tube is exhausted, the electric resistance of the heating tube fluctuates and consequently, the temperature profile inside the furnace changes, and this causes a problem. In other words, there is such a problem that since the change or fluctuation in the temperature profile or distribution inside the furnace may cause the change in the quality and performance of the products treated by the furnace, it becomes impossible to continue using the furnace as it is any more.

When a detectable change of the temperature inside the furnace is perceived, due to the exhaustion of the heating tube, the element should necessarily be replaced by a new one, and it is an essential matter for an industrial furnace, to minimize the period of replacement of heating tubes, since not only such replacement of heating tubes is highly costly but also there is a need for much labor and time to maintain safety in the replacement operation and cool, disassemble and assemble the furnace as well as heat up the furnace after assembling and moreover, the energy loss is not small.

The inventors have attained the present invention as the result of examinations of the factors in generation of the above-mentioned shortcomings of the high-temperature heating furnaces. In other words, paying attention to the fact that there is a relation between the life of the heating tube and the material surrounding the periphery thereof, the inventors examined various materials, and as a result, the inventors have attained the present invention through a confirmation that an excellent result can be obtained when carbon fiber is employed as a principal material.

It is, therefore, an object of the present invention to provide a resistance heating element for an industrial furnace capable of prolonging the life thereof. Another object of the present invention is to provide an improved heating element with high performance, of low manufacturing cost as well as easy to manufacture for such an industrial heating furnace.

SUMMARY OF THE INVENTION

The above-mentioned objects can be attained basically by means of an electric resistance heating element formed by providing a layer essentially comprising carbon fiber around the surface of a carbonaceous electric resistance heating tube.

The present invention relates to an electric resistance heating element formed by providing a layer essentially comprising carbon fiber on the surface of a carbonaceous electric resistance tube in such a tubular shape as a cylinder and a heating furnace using this heating element.

THE DRAWINGS

THE PREFERRED EMBODIMENTS

In order to facilitate the understanding of the present invention, first, the structure of a conventional Tamman furnace will be described hereinunder.

Figure 1:
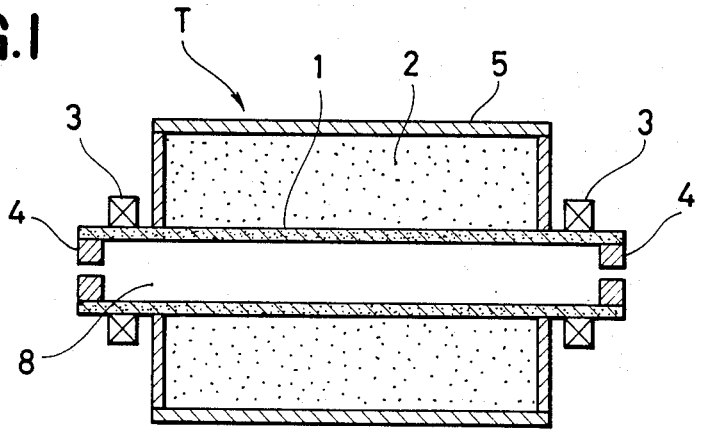
FIG. 1 is a sectional view of an example of the conventional Tamman high-temperature heating furnace.

A Tamman furnace T shown in FIG. 1 is arranged such that a cylindrical electric resistance heating tube 1 is covered with a furnace outer shell 5, and a thermal insulating material 2 is provided in the space between the surface of the heating tube 1 and the furnace outer shell 5, and moreover, electrodes 3 are provided at both ends of the heating tube 1 so that the heating element 1 is heated to a high temperature by supplying a current across these electrodes. In addition, an inlet/outlet gas sealing part 4 is provided on the inner surface of each of the ends of the hollow heating tube 1, and a heat treatment chamber 8 is formed by the space inside the heating tube 1 sealed with these gas sealing parts 4.

Figure 2:
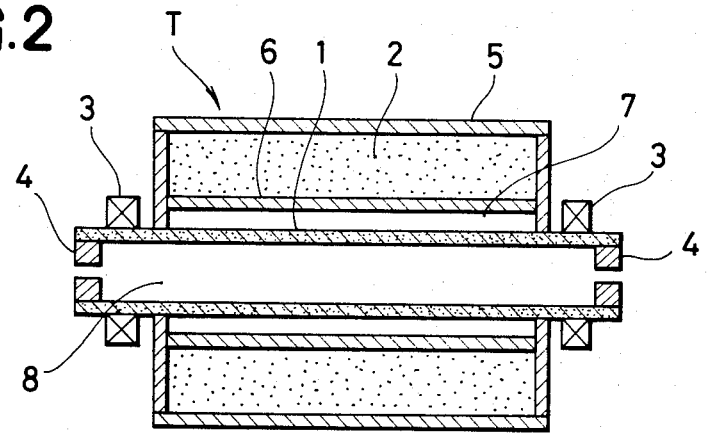
FIG. 2 is a sectional view of an essential part of a conventional Tamman heating furnace having a different structure.

FIG. 2 shows another example of the heating furnace and this is also a conventional apparatus. The apparatus has a protecting tube 6, and a hollow part 7 is formed between the heating element protecting tube 6 and the surface of the heating tube 1, and moreover, the thermal insulating layer 2 provided covering the periphery of the heating tube 1 not directly but through the hollow part 7, thereby allowing the thermal insulating effect to be intensified.

By the way, in the Tamman heating furnaces having the above-described structures, the electric resistance heating tube 1 itself has therein a space for heat-treatment, i.e., an object to be thermally treated, i.e., the heat treatment chamber 8, which is heated up by charging electric power and maintained at a given temperature. However, since the heating element radiates heat from both the inner and outer surfaces, it is necessary to thermally insulate the heating element by means of the thermal insulating layer 2 or the hollow part 7 and the protecting tube 6 in order to maintain the atmosphere temperature inside the heat treatment chamber 8 constant and prevent the radiation of heat from the outer surface.

It is to be noted that although it is necessary to provide each sealing part with such a gap so that a sample can pass therethrough in case of continuously process, it is also possible to hermetically seal the heat treatment chamber 8 as a flange structure in case of a batch-system heating process.

The thermal insulating layer 2 inside the furnace outer shell 5 and the inside of the heating tube (including the space between the protecting tube 6 and the heating element 1) are constantly filled with an inert gas, such as nitrogen, argon or the like, or maintained under a vacuum in order to suppress the oxidative deterioration of an object to be thermally treated and the heating tube. Moreover, as the thermal insulating layer or material, carbon or graphite powder or granular matter or the like is generally employed.

The heating element protecting tube 6 shown in FIG. 2 is provided to avoid a direct contact of the heating tube 1 to the thermal insulating material 2 and the heating tube 1 as well as further protecting the atmosphere around the heating element from the outside.

However, it is known that in both cases, if a high-temperature heating is continued for a long period of time, the outer surface of the heating tube is largely worn, causing the life thereof to be shortened.

An improved heat treatment furnace employing the heating element according to the present invention will be described hereinunder.

Figure 3:
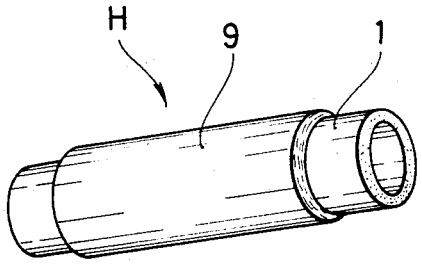
FIG. 3 shows an electric resistance heating element in accordance with a preferred embodiment of the present invention having a layer comprising carbon fiber provided on the surface of a heating tube made of a carbon material.

FIG. 3 is a perspective view of an electric resistance heating element H according to the present invention, which has a carbon fiber 9 wound and laminated on the surface of the heating tube 1 made of a carbon material.

Figure 4:
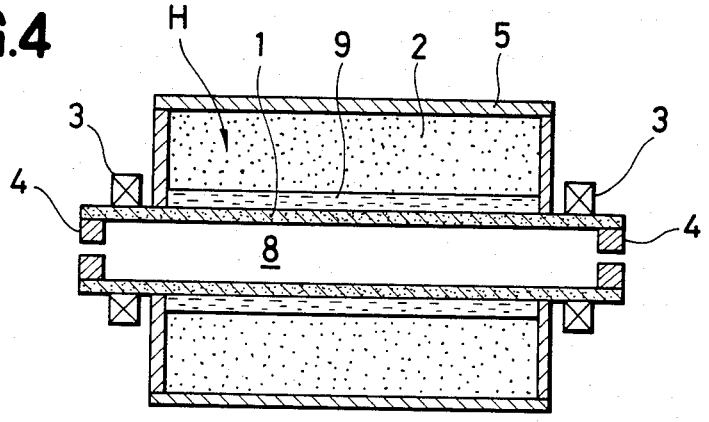
FIG. 4 is a sectional view of an essential part of a Tamman furnace in accordance with the preferred embodiment of the present invention using the electric resistance heating element shown in FIG. 3.

In FIG. 3, the carbon fiber 9 is wound and laminated along the periphery of the heating tube 1 to form a protecting layer. FIG. 4 shows an example of the Tamman heating furnace having the heating element H according to the present invention shown in FIG. 3, in which carbon fiber 9 wound and laminated on the heating tube 1 is made present between the element 1 and the thermal insulating material 2.

The carbon fiber constituting the layer on the heating tube, in the present invention, may preferably be selected from general carbon fibers made from organic fibers such as pitch, cellulosic or acrylic fibers carbonized at a temperature higher than 800° C. in an inert gas atmosphere. It is also possible to employ graphite fiber graphitized at a temperature higher than 2000° C. There is no significant difference between carbon fiber and graphite fiber, since during a long period of time of directly contacting a high temperature heating tube the fiber may finally be graphitized.

In either case, it is possible to employ either of carbon and graphite fibers, since directly contacting with the heating tube 1 for a long period of time, the fiber progresses in its graphitization.

Generally commercial carbon fibers are often provided with sizing agent such as epoxy or polyvinyl alcohol resin. These sizing agents are decomposed to gasify on heating, causing the atmosphere inside the furnace to be contaminated. Therefore, it is necessary to thoroughly preheat the carbon fiber and replace the decomposition gas evolved in the furnace during the period, before an object to be thermally treated is put in the furnace, or it is preferable to remove the decomposition gas before the carbon fiber is wound on the heating tube.

Furthermore, when the carbon fiber thread is wound and laminated, it is necessary to closely wind the carbon fiber thread so that it closely contacts the heating tube and moreover there is no gap between the turns of the thread. It is also possible to wind and laminate the carbon fiber in such a way that such a device as a winder is employed and the carbon fiber is fed under a constant tension while the heating tube is being rotated. In this case, it is preferable to closely wind the carbon fiber so that the turns thereof are substantially parallel and closely contacting with each other.

The denier of the carbon fiber employed is not particularly limited, and a fiber bundle consisting of 1000 to 10,000 filaments, each having a diameter of 0.5 to 5$\mu$ may be preferably employed. However, a tow having a larger denier may suitably be employed, so long as it is wound not in the shape of a rope but in the shape of a spread tape. Moreover, since carbon fibers have a low elongation at break as well as a low friction coefficient, such consideration is needed as for forming each of the end parts of the laminated layer into, e.g., a taper shape in order to keep the winding in shape.

The lamination thickness of the carbon fiber layer on the heating tube surface cannot be determined absolutely, but owing to the wall thickness and the like dimensions of the heating tube or to other environmental conditions including thermal insulation, the outer shell dimension, etc., it should be determined. For example, a lamination thickness of about 10 to 20 mm is sufficient for a heating tube wall thickness of about 5 to 10 mm, thereby allowing the life of the heating tube to be prolonged 2 to 3 times as long as that of a heating tube having no winding. However, a lamination thickness of about 1 to 2 mm is not preferable, since such a lamination thickness does not provide the heating tube with a satisfactory wastage-suppressing effect.

As described above, the present invention is characterized by employing as the heating element for a high-temperature heating furnace, a kind of a composite heating element formed by laminating a carbon fiber layer on the surface of the carbon material. Although the reason why such a composite structure element can prolong the life of the heating element is not entirely clear, the inventors conjecture as follows as the result of experiments and observation.

When a Tamman furnace employing a simple carbon (or graphite) pipe as a heating element such as shown in FIG. 1 is used at a temperature higher than 2000° C., the state of the wastage of the heating tube is generally as follows.

Namely, in the part near the center in the longitudinal direction of the pipe, where the temperature is highest, it is observed that the pipe is wasted most intensely, and the outer surface of the heating tube is more conspicuously worn than the inner surface thereof. The same is the case with such a furnace incorporating the protecting tube 6 as shown in FIG. 2. Moreover, even in case of employing a protecting tube of the same material as the heating tube, wastage is great at the outer surface of the heating tube but slight at the inner surfaces of the protecting tube and the heating tube.

Although various factors can be regarded in the wastage or wear of the carbon material under a high temperature, it is hardly considered that oxidation is a principal factor in the above-described phenomenon, since the phenomenon takes place in an inert atmosphere containing substantially no oxygen, for example, in a nitrogen atmosphere having an oxygen content of less than 10 ppm, more practically an oxygen content on the order of 1 ppm.

The inventors consider that the principal factor in the wastage is the evaporating phenomenon of carbon under a high temperature. For instance, according to "Carbon and Graphite Handbook" by C. L. Mantell (1968, Interscience), about $10^{-2}$ g/cm$^2$ hr carbon evaporates at 2500 K. Therefore, it is possible to consider that if the carbonaceous heating element is held under a high temperature, more than 2000° C., for a long period of time, the evaporation of carbon from the surface of the heating tube causes the wastage of the same. Then, if there is a nonuniformity generated in the temperature of the heating tube, and if a local hot spot is generated, the evaporation and wastage at the portion become remarkably large. Consequently, it is necessary to avoid the generation of such a hot spot in order to enable a high-temperature heating furnace to be stably used for a long period of time.

Now, according to the observation by the inventors, the wastage of the heating tube made of a graphite pipe is conspicuous particularly about the outer surface of the pipe, as described above. This means that when the heating tube is resistance heated, the outer surface thereof is in a condition where a hot spot is easily generated. It can be supposed that one of the factors to generate a hot spot is a thermal boundary condition. Namely, in such heating furnaces as exemplified in FIGS. 1 and 2, the outer surface of the heating tube radiates a larger amount of heat than the inner surface thereof. If nonuniformity is produced in such a radiating condition, unevenness is produced in the heating tube surface temperature, causing the production of a hot spot. Particularly, in case of employing a powdery or granular thermal insulating material such as graphite powder, it is difficult to maintain constant the thermal insulation condition.

On the other hand, in case of employing a heating element having such a structure in which carbon fiber is wound on a heating tube (graphite pipe), the layer of the wound carbon fiber functions as an excellent thermal insulating material, so that a heating element having a uniform thermal insulating layer on the outer surface is formed. For instance, according to studies done by the inventors, it has been confirmed that in case of employing such a heating furnace having a double-pipe structure as shown in FIG. 2 and using a heating tube (the graphite pipe diameter: 70 mm $\phi$) wound with carbon fiber with a thickness of about 15 mm, the power consumption has been reduced by about 40% and also the outer shell surface temperature has been lowered by thus winding the carbon fiber on the surface of the heating tube.

In other words, it is possible to consider that functioning as an excellent thermal insulating material, the carbon fiber layer is effective for suppressing the radiation of heat, and this, as a result, usefully acts for prolonging the life of the heating element.

Another cause of the generation of a hot spot is an electrical boundary condition of the heating tube surface. While in Tamman furnace type heating furnaces, electric current is directly supplied to the heating tube, in cases where the temperature is in a high-temperature region of above 2000° C., a carbon material is generally employed as the thermal insulating material provided around the heating tube. Since the carbon material is essentially conductive, if such a thermal insulating material is contacted with the heating tube electricity may leak through the thermal insulating material. Although this causes no problem in the actual use, since such a contact resistance is much larger than the electrical resistance of the heating tube itself and consequently the major part of current flows through the heating tube, and the leak current through the thermal insulating material is negligibly small, it is also considered that the fact that the wastage of the outer surface of the heating tube is intense tells such an electrical boundary condition of the outer surface is one of the causes of the generation of a hot spot.

For instance, in a heating furnace which employs as a thermal insulating material a felt-like substance obtained by arranging short fibers of carbon fiber at random and subjecting it to needle punching and in which the felt-like substance obtained is wound and laminated so that it contacts with a heating tube made of a graphite pipe, the wastage of the heating-element outer surface is intense, so that the heating furnace cannot be stably used for a long period of time. Therefore, it is necessary to suppress the wastage by winding carbon fiber as in accord with the present invention.

It may be regarded in this respect that it may not be preferable to wind carbon fiber since carbon fiber itself has electrical conductivity, but according to the inventor's experiment, it has been confirmed that carbon fiber functions as an extremely excellent insulator if, as in the present invention, a carbon fiber thread is wound on the outer surface of the heating tube.

Namely, with a sample structure in which carbon fiber was wound on a graphite pipe (the outside diameter: 70 mm $\phi$) employed as the heating element so as to have a thickness of 15 mm and be perpendicular to the axis of the pipe, the electrical resistance of the graphite pipe was measured. As a result, the electrical resistance was substantially the same as that measured before the carbon fiber was wound. In other words, the wound carbon fiber can be practically regarded as an electrical insulator. On the other hand, the graphite pipe was wound with a needle punched carbon fiber feld (weight: 400 g/m$^2$, thickness: about 7 cm) and the electrical resistance of the graphite pipe was similarly measured. As a result, it was found that the resistance decreased by about 7% as compared with that measured before the felt was wound. Thus, it is possible to consider that the felt-like substance wherein carbon fibers are arranged at random is electrically conductive.

That is the reason why although carbon fiber is electrically conductive, this property is present in the direction of the fiber axis, and the contact resistance between fibers is so larger than this that the carbon fiber wound perpendicularly to the axis of the heating element, according to the present invention, can be regarded as an insulator, while on the other hand, a felt-like substance having a random arrangement where a component parallel to the pipe axis can be present shows electrical conductivity. In other words, the effect of the present invention can be considered that by such a method as winding and laminating carbon fiber, it becomes possible to provide the heating element surface with excellent thermal and electrical boundary conditions, thereby realizing suppression of the wastage of the heating element.

It is preferable in the present invention that the carbonaceous heating tube constituting an electric resistance heating element and the layer essentially comprising carbon fiber provided on the outer surface thereof have a bulk density difference of at least 0.1 therebetween and moreover, the apparent specific gravity of the carbon fiber layer be smaller than that of the carbonaceous heating tube.

In other words, when the apparent density of the layer essentially comprising carbon fiber constituting the radiating surface of the heating element is smaller than that of the carbonaceous heating tube constituting the inner layer part thereof, the layer as the outer layer part essentially comprising carbon fiber functions as a kind of thermal insulating layer, usefully acting for providing a uniform temperature profile or distribution in the heating element.

Figure 5:
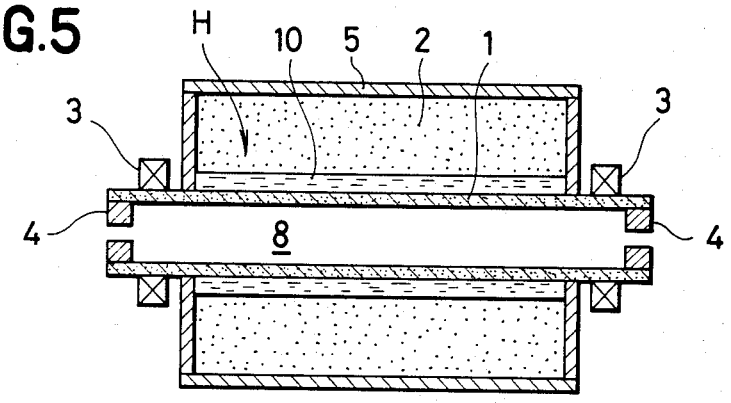
FIG. 5 is a sectional view of a Tamman furnace in accordance with another preferred embodiment of the present invention.

It is desirable that the apparent density of the layer, essentially comprising carbon fiber, constituting the radiating surface of the heating element be not more than 1.4, preferably in a range of 0.7 to 1.4, and it is preferable that this apparent density be made small within such a range that a shape as a composite heating element such as shown in FIG. 5 can be maintained. On the other hand, it is not preferable to make this apparent density larger than 1.4, since if it is so much large, there is substantially no difference in the apparent density between the layer and the carbon material (in general, a high-density graphite material having a density of not less than 1.5 is preferable) as a main heating part of the inner layer, so that the purpose of the present invention cannot be well attained.

Although such a layer comprising carbon fiber can be easily formed by simply closely winding and laminating carbon fiber, as described above the formation of the layer can be also realized by some other methods.

FIG. 5 shows a sectional side elevational view of a heating furnace employing a cylindrical heating tube made of a carbon material in another form. Shown is a Tamman heating furnace employing the electric resistance heating element H obtained by integrally laminating on the outer peripheral surface of the heating tube 1 a carbon fiber layer 10 made of a carbon-carbon composite material obtained by impregnating a fibrous structure, such as carbon fiber cloth, felt, etc., with resin and then carbonizing the same on heating; having the furnace outer shell 5 provided around the periphery of the heating element H; and moreover having the carbon or graphite powder or granular thermal insulating material 2 charged between the furnace outer shell 5 and the carbon fiber layer 10.

Figure 6:
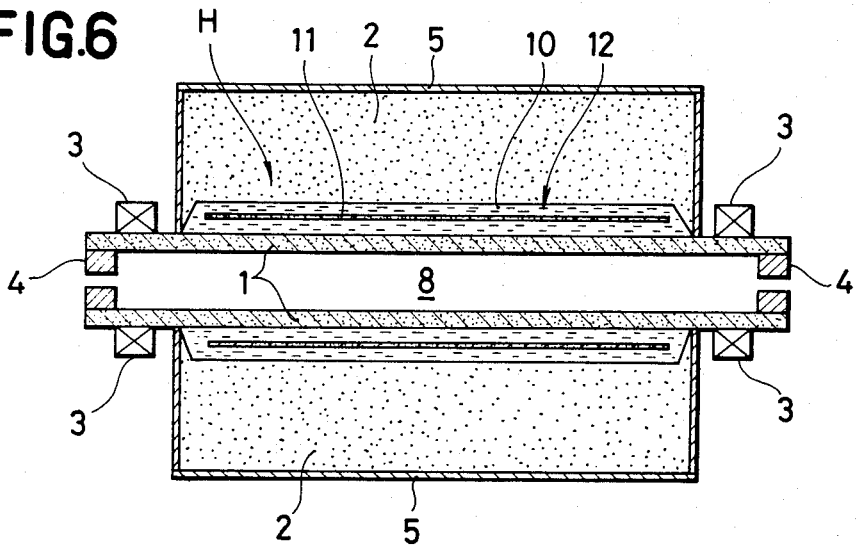
FIG. 6 is a sectional view of a Tamman furnace in accordance with still another preferred embodiment of the present invention.

Moreover, FIG. 6 is a sectional view of an example of a Tamman heating furnace employing the electric resistance heating element H in another form of the present invention. Such an electric resistance heating element H is employed in the furnace as having the carbon fiber layer 10 and a sheet-shaped graphite (film) 11 laminated into at least two layers, as a laminated substance 12, around the periphery of the heating tube 1 made of a carbon material.

Although the laminated substance 12 thus wound is excellent in thermal insulating effects as compared with the winding only of carbon fiber, it on the other hand is difficult to wind closely and integrally the laminated substance 12. Therefore, it is preferable to prepare such a one as being preparatively formed into the laminated substance 12 and wind the same around the surface of the heating tube 1.

As the film- or sheet-shaped substance employed here, it is preferable to use a flexible sheet-shaped substance, such as obtained by pressure-molding expanded graphite, having a thickness of 0.1 to 1 mm. The film- or sheet-shaped substance may be a laminated sheet obtained by piling up a plurality of unit sheets and hardening the same with a carbon material or a sheet-shaped substance obtained by making carbon fiber into paper and hardening the same with a carbonaceous binder.

If it is large in flexibility, the above-mentioned film or sheet can be cylindrically wound between the layers of carbon fiber thread when it is wound. In this case, it is preferable that the innermost layer directly contacting the heating tube be the carbon fiber, and after the carbon fiber is wound into a thickness of at least 2 to 5 mm the sheet should be put thereon and moreover, thread should be wound on the outside thereof. The reason for this is that if the innermost layer is the film- or sheet-shaped substance, it is difficult to allow the innermost layer and the heating tube surface to contact uniformly and closely with each other, so that the boundary conditions of the heating element with the outside may be deteriorated to the contrary. In addition, the number of lamination of the sheet-shaped substance is not necessarily one, and it is also possible to wind a plurality of sheets of the sheet-shaped substance, e.g., 2 to 3 sheets, through the lamination layers of the carbon fiber.

If the radiating surface of the heating element is formed by employing a carbon material essentially comprising carbon fiber having the smallest apparent density in the carbon materials constituting the heating element, the electric resistance of the carbon material forming the radiating surface is the largest and moreover, the thermal conductivity thereof is the smallest. Accordingly, when electricity is directly applied to the heating element thus arranged, since the carbon material constituting the radiating surface is larger in electric resistance than the carbon material in the inner layer thereof containing no carbon fiber, it is difficult for the electricity to flow through the carbon material constituting the radiating surface, so that the amount of heat radiating from the heating element is small and moreover, since the thermal conductivity thereof is small to the contrary, the carbon material constituting the radiating surface functions as a thermal insulating layer with respect to the inside carbon material, so that the temperature profile of the heating tube is uniform and stable, thereby generation of a hot spot may be prevented as described above.

There are such film- or sheet-shaped carbon or graphite as "Grafoil" and the like marketed by Union Carbide Corp. These show a remarkable anisotropism in the thermal characteristics and have such a feature that the thermal conductivity is high on the plane thereof but low in the direction perpendicular to the plane. The present invention effectively utilizes this feature. In other words, it becomes possible to further effectively suppress the radiation of heat from the heating tube outside surface to the outside by winding up such film- or sheet-shaped carbon or graphite together with the lamination layers formed by winding fibrous carbon.

Heat transfer is mainly effected by radiation at high temperatures, particularly above 2000° C., and therefore, it becomes possible to further reduce the radiation of heat from the surface of the heating element to the outside by cutting off this radiation heat. Also at this point, cylindrically wrapping in the sheet-shaped substance permits the heat radiation to be reflected toward the inside, thereby attaining improvement in the thermal insulating effect.

Although the Tamman heating furnace with the carbonaceous heating tube which itself has therein a heat treatment chamber for an object to be treated has been practically described above, it of course is possible to employ the electric resistance heating element according to the present invention as a heating element for a high-temperature heating furnace having a different structure from the above.

Heating furnaces, particularly Tamman heating furnaces, employing the electric resistance heating element according to the present invention are extremely useful for heating or heat treatment through the employment of a high-temperature heating atmosphere in which the carbon material constituting a carbonaceous heating element is wasted by means of heat, for example, as a graphitizing furnace for heating carbon fiber in an inert atmosphere, such as nitrogen, argon, etc., at not lower than 2000° C. in order to convert the carbon fiber into graphite fiber.

The effects of the heating furnace employing the electric resistance heating element according to the present invention will be described hereinunder in conjunction with examples.

EXAMPLE 1

A cylindrical Tamman furnace with an outer shell diameter of 450 mm $\phi$ and a length of 60 cm was assembled by using a graphite pipe (manufactured by Nippon Carbon Ind. Co. Ltd. of Japan) as the heating tube.

The graphite pipe had an inside diameter of 30 mm $\phi$, an outside diameter of 45 mm $\phi$ and a length of 1 m. Carbon fiber ("Torayca" T-300, manufactured by Toray Ind. Inc. of Japan, having no sizing agent) was tightly and closely wound around the surface of the graphite pipe over 50 cm in the center thereof along the axis of the pipe and into a thickness of 10 mm.

The density of the wound layer of the carbon fiber, was about 0.9 g/cc, while that of the graphite pipe was about 1.6 g/cc. The space between the outer shell and the heating element was filled with graphite powder as a thermal insulating material.

Electrodes were connected to both ends of the graphite pipe, and an electric current was supplied therebetween.

With the temperature inside the furnace maintained at 2600° C. under a nitrogen atmosphere, heating was continued.

The electric current and also the temperature was stable for 20 days and it was possible to continuously operate under the stable condition. However, on the 21st day from the start of heating, fluctuation in the electric current was detected. Therefore, the power was switched off, and the furnace was cooled down and then disassembled. The appearance of the outer face of the carbon fiber layer wound around the surface of the graphite pipe practically showed its original shape and had no change. However, when the earbon fiber layer was peeled off, it was found that the graphite pipe had been made embrittle and crumbled during the operation of peeling the layer, and therefore, the pipe could not be used for a heating element any more.

For comparison, a Tamman furnace was assembled with the heating tube of a similar graphite pipe as hereinbefore described but with no carbon fiber layer wound on its surface. The temperature inside the furnace was similarly maintained at 2600° C. under a nitrogen atmosphere. As a result, on the 7th day from the start of heating, the current suddenly dropped and it was unable to hold the temperature of the furnace. When the furnace was disassembled, the portion in the center of the heating tube, where the temperature was supposed to be highest, had become thin and broken.

Thus, the life of the furnace, i.e. the life of the heating tube, as hereinbefore described in the present invention is able to be prolonged double or more by employing the heating tube having a layer of carbon fiber on its surface.

EXAMPLE 2

Although similar to the above-described Example 1, the carbon fiber to be wound was impregnated with phenolic resin, and after being wound, the carbon fiber was carbonized at 1500° C. Such a composite heating element was formed as having a carbon fiber-carbon composite substance as the outer layer. The density of the outer layer was 1.3 g/cc, which was a value 0.3 smaller than that of the graphite pipe as the inner layer, 1.6 g/cc.

With the above-described composite heating element employed, heating was effected similarly to the Example 1. As a result, it was possible to use the heating element continuously over 24 days.

EXAMPLE 3

A graphite pipe (the density of 1.55 g/cc), with an inside diameter of 40 mm $\phi$, an outside diameter of 70 mm and a length of 1 m was prepared. Carbon fiber, "Torayca" T-300, was wound around its surface over 70 cm in the center thereof and into a thickness of 4 mm so that the winding direction was substantially perpendicular to the axis of the graphite pipe.

The density of the wound carbon fiber layer was 0.95 g/cc. "Grafoil", a sheet-shaped graphite with a thickness of 0.6 mm was put over the layer and then it was wrapped with the carbon fiber, until the overall thickness of the laminated layer of carbon fiber with the graphite sheet was about 10 mm. Thus, such a composite heating element was formed as having the graphite sheet wrapped between the carbon fiber layers.

A Tamman furnace was assembled with this composite heating element, and power was supplied to maintain the temperature of the furnace at 2800° C. under a nitrogen atmosphere.

The temperature was stably maintained for 30 days, therefore the life of the furnace was proved to be more than 30 days.

We claim:

1. An improved electric resistance heating element comprising a carbonaceous resistance heating tube and a layer of carbon fibers closely wound on an outer surface thereof substantially perpendicularly to an axis of the tube.

2. An improved electric resistance heating as defined in claim 1, wherein the bulk density of said layer is not greater than about 1.4 g/cc.

3. An improved electric resistance heating element as defined in claim 2, wherein the bulk density of said layer is lower by at least 0.1 g/cc than that of said heating tube.

4. An improved electric resistance heating as defined in claim 1, wherein the turns of said carbon fiber are closely contacted with each other on the surface of said carbonaceous heating tube.

5. An improved electric resistance heating element as defined in claim 1, wherein said layer is formed into a taper shape at both ends of said layer.

6. An improved electric resistance heating element as defined in claim 1, wherein said layer is a carbon fibercarbon composite material obtained by impregnating carbon fiber with resin and carbonizing and/or graphitizing the same.

7. An improved electric resistance heating element as defined in claim 1, wherein said layer is a laminated structure comprising carbon fiber and film- or sheet-shaped carbon or graphite.

8. An improved electric resistance heating furnace comprising a carbonaceous electric resistance heating tube having a heat treatment chamber therein along the center axis of said tube, a layer of carbon fiber closely wound on an outer surface thereof substantially perpendicularly to said axis and a thermal insulating material said layer.

9. An improved electric resistance heating furnace as defined in claim 8, wherein the temperature inside said heat treatment chamber is at least 1000° C.

10. An improved electric resistance heating furnace as defined in claim 8, wherein the temperature inside said heat treatment chamber is within a range of about 2000° to 3000° C.

11. An improved electric resistance heating element as defined in claim 9, wherein the bulk density of said layer is not greater than about 1.4 g/cc.

12. An improved electric resistance heating element as defined in claim 8, wherein the bulk density of said layer is lower by at least 0.1 g/cc than that of said heating tube.

13. An improved electric resistance heating element as defined in claim 8, wherein the turns of said carbon fiber are closely contacted with each other on the surface of said carbonaceous heating tube.

14. An improved electric resistance heating element as defined in claim 8, wherein said layer is formed into a taper shape at both ends of said layer.

15. An improved electric resistance heating element as defined in claim 8 wherein said layer is a carbon fibercarbon composite material obtained by impregnating carbon fiber with resin and carbonizing and/or graphitizing the same.

16. An improved electric resistance heating element as defined in claim 8, wherein said layer is a laminated structure comprising carbon fiber and film- or sheet-shaped carbon or graphite.

* * * * *

UNITED STATES PATENT AND TRADEMARK OFFICE

CERTIFICATE OF CORRECTION

PATENT NO. : 4,490,828

DATED : December 25, 1984

INVENTOR(S) : MOTOTADA FUKUHARA ET AL

It is certified that error appears in the above-identified patent and that said Letters Patent is hereby corrected as shown below:

On the cover page, Item [30], change "February 12, 1982" to --- February 15, 1982 ---.

Signed and Sealed this

*Third* Day of *September 1985*

[SEAL]

*Attest:*

DONALD J. QUIGG

*Attesting Officer* *Acting Commissioner of Patents and Trademarks - Designate*